US005325553A

United States Patent [19]

Ripley et al.

[11] Patent Number: 5,325,553

[45] Date of Patent: Jul. 5, 1994

[54] MATTRESS SPRING STRUCTURE WITH REINFORCING FRAME IN THE LUMBAR AREA

[75] Inventors: Craig M. Ripley, Proctorville, Ohio; Charles B. Clark, Huntington, W. Va.; Thomas L. McFadden; Jerome M. Sachs, both of Baltimore, Md.

[73] Assignee: Namaco Enterprises, Huntington, W. Va.

[21] Appl. No.: 136,801

[22] Filed: Oct. 14, 1993

Related U.S. Application Data

[63] Continuation of Ser. No. 40,506, Mar. 31, 1993, abandoned, which is a continuation of Ser. No. 934,103, Aug. 21, 1992, abandoned.

[51] Int. Cl.[5] ..... A47C 27/04; A47C 27/07

[52] U.S. Cl. ..... 5/475; 5/464

[58] Field of Search ..... 5/475, 478, 246, 248, 5/267, 260, 464

[56] References Cited

U.S. PATENT DOCUMENTS

| | | | |
|---|---|---|---|
| 2,383,157 | 8/1945 | Pink | 5/267 |
| 2,681,457 | 6/1954 | Rymland | 5/464 |
| 3,009,171 | 11/1961 | Rymland | 5/252 |
| 3,092,849 | 6/1963 | Clifton | 5/464 |
| 3,242,505 | 3/1966 | Tyhanic | 5/267 |
| 3,626,523 | 12/1971 | Robins | 5/464 |
| 3,840,915 | 10/1974 | Simon | 5/267 |
| 4,180,877 | 1/1980 | Higgins | 5/267 |
| 4,679,266 | 7/1987 | Kraft | 5/464 |
| 4,768,253 | 9/1988 | Boyd et al. | 5/464 |
| 4,771,495 | 9/1988 | Distler et al. | 5/478 |
| 4,918,773 | 4/1990 | Scott | 5/475 |
| 4,972,536 | 11/1990 | Scott | 5/464 |

*Primary Examiner*—Alexander Grosz
*Attorney, Agent, or Firm*—George J. Brandt, Jr.; Thomas R. Morrison

[57] ABSTRACT

A mattress spring structure is provided with a strengthened central area thereon to provide greater support for a user's body lumbar region when received thereon. The strengthening is provided with a continuous frame that encircles coil springs over a major expanse of the central area, this frame being connected to first and last transverse rows of coils in the central area and extra central area transverse coil rows next adjacent the said first and last rows. The frame also connected to adjacently paired longitudinally arranged coils springs in the central area at both sides of the spring structure. High carbon steel of six or nine gauge is used for the frame.

9 Claims, 2 Drawing Sheets

MATTRESS SPRING STRUCTURE WITH REINFORCING FRAME IN THE LUMBAR AREA

This is a continuation of application Ser. No. 08/040,506 filed Mar. 31, 1993, now abandoned which in turn is a continuation of application Ser. No. 07/934,103 filed Aug. 21, 1992 now abandoned.

BACKGROUND OF THE INVENTION

The present invention relates to mattress construction and, more particularly, to a mattress spring structure providing enhanced support in the area of the spring structure which in use supports the mattress area whereon the user's body lumbar region normally will be received.

Various and many mattress constructions have been produced in the past with special emphasis being given innerspring structures to deal with the differential loading on the mattress in certain areas due to differences in the weight of the parts of the user's body normally received on these certain areas. Commonly, and to take into account these differences, mattress spring structures have been strengthened with change of material gauge, varying spring tension, adding additional insulation to areas etc.

While the known practices have advantage, not enough attention has been fixed on the mattress and, correspondingly, the innerspring structure therein which is associated with reception and support of the user's lower back arch area. The user's lower back area or lumbar region is a critical one for proper support to avoid cause of back aches. Where spring structures have been modified in the past to enhance and insure lumbar region support, such has been achieved only by way of expensive and unnecessarily complicated strengthening means.

OBJECTS AND SUMMARY OF THE INVENTION

Accordingly, it is an object of the invention to provide a mattress spring structure which overcomes the drawbacks of the prior art.

It is a further object of the invention to provide a mattress spring structure which strengthens a middle or central area of the mattress spring structure in such a way that mattress service life is materially prolonged.

It is a still further object of the invention to provide strengthening of a mattress spring structure in manner applicable to a range mattress types without regard to type of innerspring or coil configuration used.

A further object is to provide a mattress spring structure specially suited to provide enhanced user body lumbar region support with a simplified frame embodiment in the structure to that purpose and done so with expediency and minimum addition to the structure weight, cost or manufacturing.

Briefly stated, a mattress spring structure is provided with a strengthened central area thereon to provide greater support for a user's body lumbar region when received thereon. The strengthening is provided with a continuous frame that encircles coil springs defining the central area over a major expanse of that central area, this frame being connected to first and last transverse rows of coils in the central area and extra central area transverse coil rows next adjacent the said first and last rows. The frame also is connected to adjacently paired longitudinally arrayed coil springs in the central area at both lateral sides of the springs structure. High carbon steel of six or nine gauge is used for the frame.

In accordance with these and other objects of the invention, there is provided a mattress spring structure comprised of a plurality of coil springs arrayed in longitudinal and transverse rows of such coil springs. These coil springs extend between upper and lower margins and opposite side margins of said structure. The coil springs of each transverse row are secured to coil springs in transverse rows of coil springs adjacent each such row with a, e.g., helical wire winding. A central area of the structure is comprised of a succession of transverse rows of coil springs defining a mattress zone normally receptive of a user's body lumbar region, and the structure includes a border piece defining the upper, lower and side margins of the structure. A frame member encircles a major expanse of the central area of the spring structure and overlays the soil springs therein. The frame member includes a pair of transverse frame segments extending, respectively, along a juncture of the coil spring rows in the succession and coil springs of extra succession transverse rows adjacent each said first and last coil spring row. The transverse frame segments each have opposite ends spaced inwardly from the side margins of the frame structure and the frame member further includes a pair of longitudinal frame segments joining the opposite ends of the transverse segments. Means are provided for securing the respective transverse frame segments to the coil springs in the said first and last coil spring rows and to coil springs of the said extra succession transverse row adjacent each said first and last row.

According to a still further feature of the invention, there is provided in a mattress spring structure a plurality of coil springs arrayed in longitudinal and transverse rows of such coil springs between upper and lower margins and opposite side margins of the structure. The coil springs in each row are aligned with the others in each said row. The structure also includes a border piece which defines the said upper, lower and side margins. Means secure each coil spring of each transverse row in paired joinder to a coil spring of an adjacent transverse row, a central area of the spring structure being defined by a selected succession of transverse rows of coil springs. A strengthening frame member is receivable exteriorly against the spring structure central area and includes a first transverse frame segment extending along a juncture of the coil springs of a transverse row first in the succession of such with an extra succession transverse row adjacent thereto. Joining members closely join together the said first transverse segment and each joined pair of coil springs in the said first succession transverse row and the extra succession transverse row adjacent thereto. A frame member second transverse frame extends along a juncture of the coil springs of a transverse row last in the selected succession of such with an extra succession transverse row adjacent thereto with there being joining members closely joining together said second transverse segment and each joined pair of coil springs in the said last transverse row and the extra succession transverse row adjacent thereto. A pair of longitudinal frame segments are spaced inwardly from the spring structure side margins and extend longitudinally in between adjacent longitudinal rows of coil springs with opposite ends of these transverse frame members being connected to opposite ends of the longitudinal frame members. Joining members closely join together the longitudinal frame segments and pairs of coil springs comprised each of a coil spring in one of the adjacent longitudinal rows and a coil spring in the other of the adjacent longitudinal rows.

The above, and other objects, features and advantages of the present invention will become apparent from the following description read in conjunction with the accompanying drawings, in which like reference numerals designate the same elements.

DESCRIPTION OF THE PREFERRED EMBODIMENT

The mattress spring structure of the present invention is characterized by its suitability for embodiment in any number of known innerspring constructions wherein special and particularized arrangements and arrayal of coil springs are employed. Use of the frame stiffening of a central area of a mattress spring is possible as the frame configuration and connection thereof is substantially unaffected by coil spring size, metal gauge etc.

Figure 1:
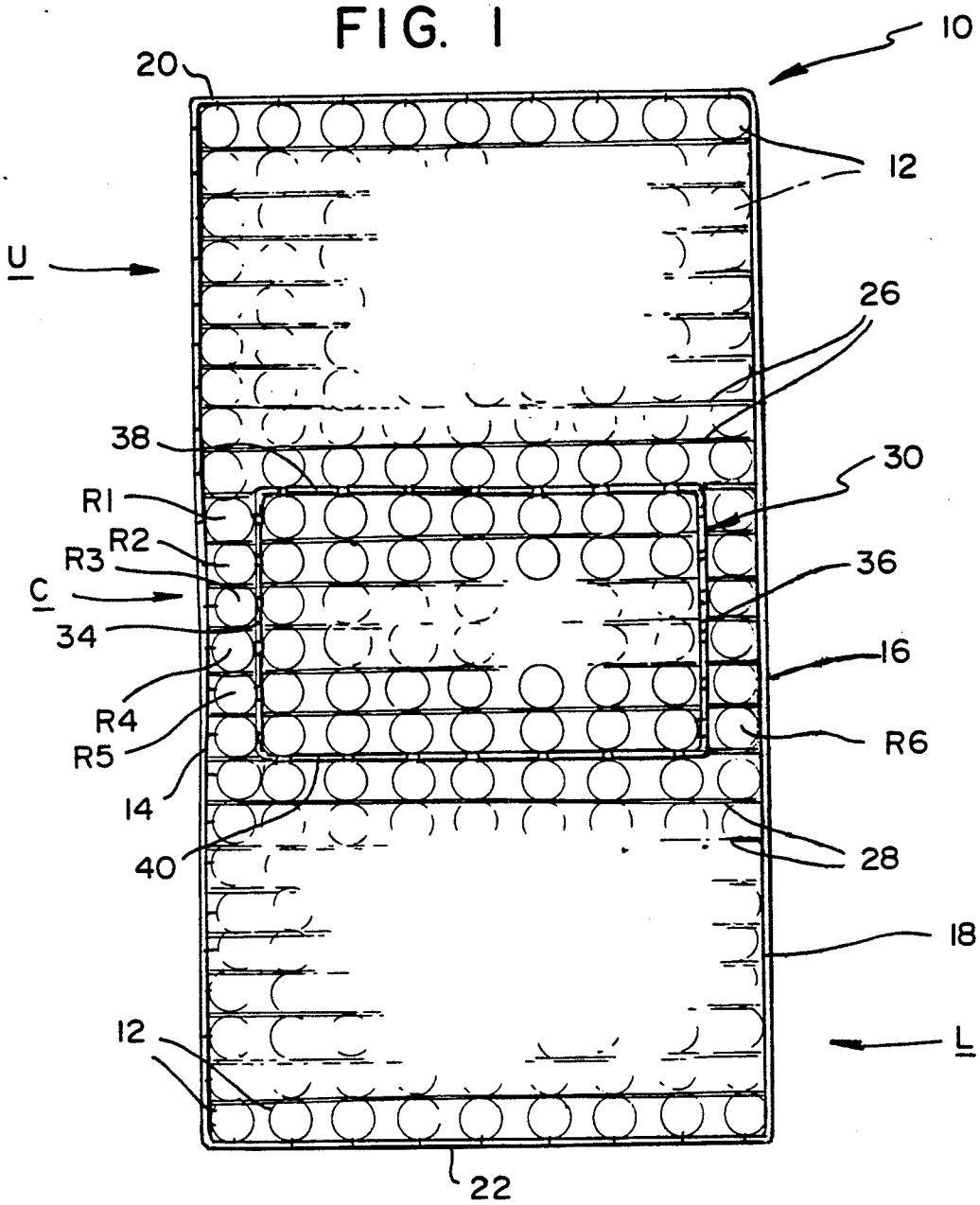
FIG. 1 is a plan view of a mattress spring structure constructed in accordance with the invention.

Referring now to FIG. 1, the mattress spring structure 10 comprises a plurality of coil springs 12 which can be arrayed in longitudinal and transverse rows as shown, these rows extending crosswise of the structure between left and right side margins of the frame as defined by the respective longitudinal margin parts 14, 16 of a conventional frame border piece 18. The rows also extend longitudinally between top and bottom frame margins 20, 22 defined by transverse margin parts of the border piece. The coil springs 12 in the FIG. 1 depicted embodiment are all of the same diameter and arrayed such that each coil spring in a given transverse or longitudinal row is aligned with the others in the given row.

The total number of springs used can vary as can spring size, compression etc. Also, the coil spring alignment can vary, e.g., a coil spring in one row need not align with one in an adjacent row, the exception to the last-noted placement being that the springs in the uppermost and lowermost transverse rows of springs included in a spring structure central area should be at least in part pairable with extra central area rows of springs next adjacent each upper and lowermost rows so that the coil springs in these can be companion connected to each other and to a frame member 30 as depicted in FIG. 1 and in manner as to be described below. In like manner, springs in longitudinal rows at side parts of the central area should be at least in part pairable with adjacent row springs.

Each transverse row of coil springs of the frame structure is joined to an adjacent row in known manner, for example, with helical wire windings 26, these windings also being secured to the border piece as at 28. Further, the perimeter coil springs each can be connected to the border piece with known types of connectors (not shown).

Figure 2:
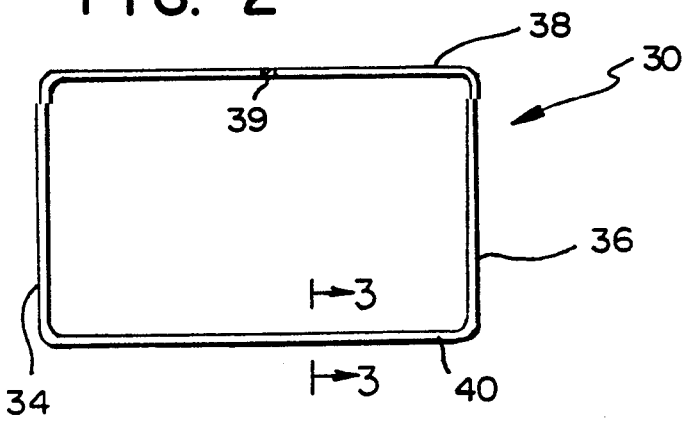
FIG. 2 is a plan view of the frame which is connected to the coil springs in the spring structure central area when strengthening is provided to enhance support of a user's body lumbar region which normally will be received on that area of the spring structure.
Figure 3:
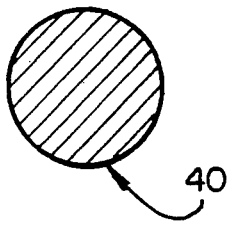
FIG. 3 is a section view, on enlarged scale, through the frame member taken on the line III—III in FIG. 2.

Frame member 30 is a unitary component having longitudinal side segments 34, 36 joined to transverse segments 38, 40 in continuous encircling course. As seen from FIGS. 2 and 3, the frame conveniently can be fabricated from a length of high carbon steel rod of, e.g., 6 or 9 gauge which is shaped into the rectangular plan profile shown, and the confronting rod opposite ends welded together as at 39. The frame member is depicted as having a circular cross section, but it is understood that same could be square, hexagonal etc, as well.

Figure 4:
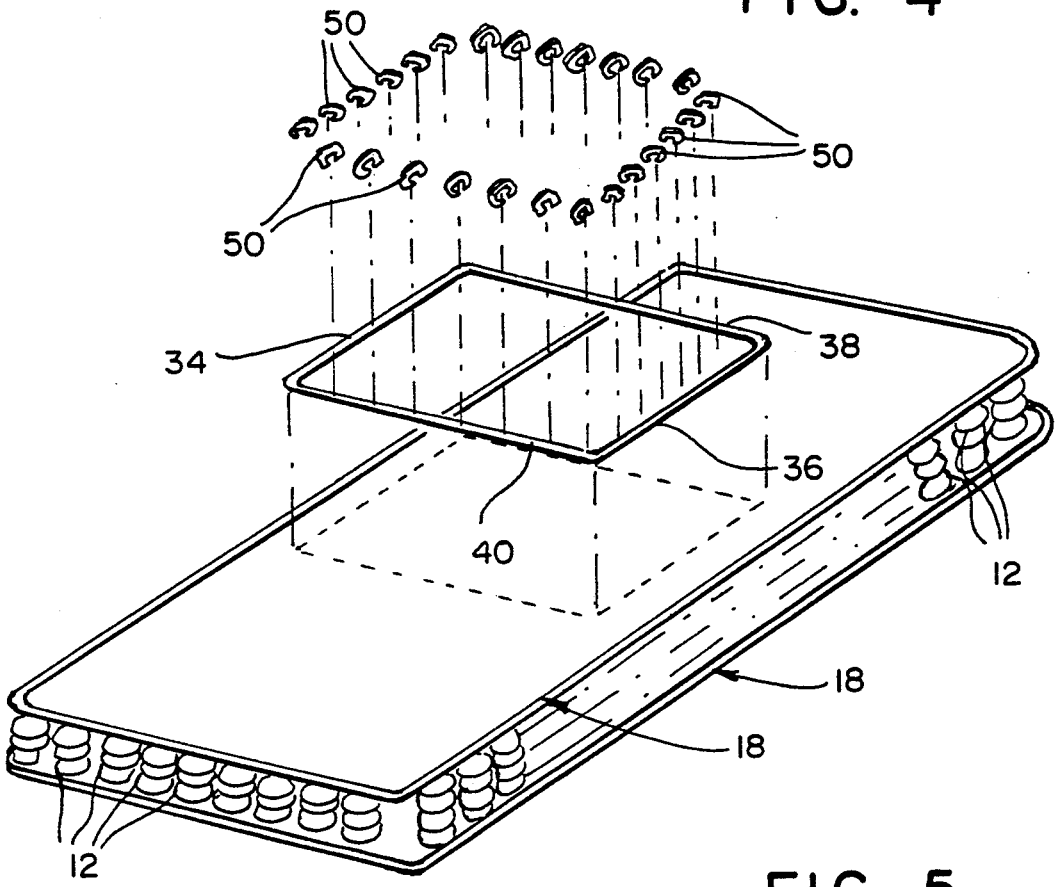
FIG. 4 is an exploded perspective view of the frame structure shown in FIG. 1.

Placement positioning of the frame member as well as means by which its secured to the frame structure is readily seen with reference to the exploded showing of FIG. 4.

With reference again to FIG. 1, frame 30 member is mounted on the coil springs in such manner as to encircle a major expanse of a selected succession of transverse rows of coil springs which define a central area C of the structure, these being designated R1–R6. In that disposition, the segments 38, 40 of the frame overlay the junctures, respectively, of the succession uppermost and lowermost coil spring rows R1 and R6 with respective frame upper area U and lower area L coil spring rows next adjacent rows R1 and R6.

The opposite ends of the segments 38, 40 it will be noted are spaced inwardly at least one spring diameter from the side margins of the spring structure. Such opposite ends are situated at a location intervening the lateralmost longitudinal spring row in the central area and the next inboard or adjacent rows to the said lateralmost rows.

Figure 5:
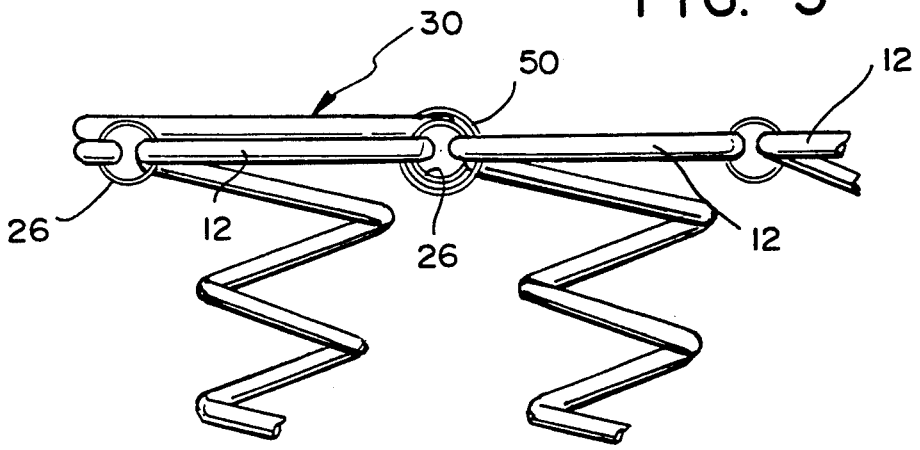
FIG. 5 is a fragmentary vertical sectional view depicting the manner in which the frame is secured to the coil springs with fastener clips.

Segment 38 is connected to each of the transverse paired coil springs in row R1 and the extra central area transverse row next above, except there is no connection to the springs of the rows above termed as lateralmost ones. This connection can be effected with fastener clips 50 as shown in FIG. 5. This joining together of the elements can be made with windings encircling the elements and the windings being deformed closely against the encircled structures. The connection also can be made with hog rings, fasteners commonly used in this art. Segment 40 is connected in like fashion with the transverse row R6 and the transverse row of area L next below.

The longitudinal frame segments 34, 36 are connected to paired coil springs of the longitudinally spring rows first and second closest to the side margins of the spring structure. If the frame member was made narrower, the frame segments 34, 36 could locate in between the second and third longitudinal spring rows in which case the segments would be connected to paired coils in these rows.

The sum effect of connecting the frame member to the coil springs in the manner aforesaid is to restrict travel movement of these springs responsive to imposition of user body weight thereon. This strengthens the central zone C where the user's body lumbar region normally will be received.

The numbers of transverse rows of coil springs can be varied depending on spring size. The FIG. 1 depiction is representative of a desired arrangement wherein the areas U and L have each the same number of rows (9)

but three greater than used in area C (6). A row proportion for the areas U, C and L of 3:2:3 is advantageous.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a mattress spring structure, a plurality of coil springs arrayed in longitudinal and transverse rows of such coil springs between upper and lower margins and opposite side margins of said spring structure, with the coils in each row aligned with the others in each said row, the structure including a border piece which defines the said upper, lower and side margins, means securing each coil spring of each transverse row in paired joinder to a coil spring of an adjacent transverse row, a central area of the spring structure being defined by a selected succession of transverse rows of coil springs, a strengthening frame member receivable exteriorly against and encircling a major expanse of the spring structure central area, the frame member comprising a first transverse frame segment extending along a juncture of the coil springs of a transverse row first in selected succession of such with an extra succession transverse row adjacent thereto, there being joining members closely joining together said first transverse segment and each joined pair of coil springs in the said first succession transverse row and the extra succession transverse row adjacent thereto, a second transverse frame segment extending along a juncture of the coil springs of a transverse row last in the selected succession of such with an extra succession transverse row adjacent thereto, there being joining members closely joining together said second transverse segment and each joined pair of coil springs in the last transverse row and the extra succession transverse row adjacent thereto, and a pair of longitudinal frame segments spaced inwardly from the spring structure side margins and extending longitudinally in between adjacent longitudinal rows of coil springs, opposite ends of the transverse frame members being connected to opposite ends of the longitudinal frame members, there being joining members, closely joining together said longitudinal frame segments and successive ones of pairs of coil springs comprised each of a coil spring in one of the adjacent longitudinal rows and a coil spring in the other of the adjacent longitudinal rows.

2. The mattress spring structure of claim 1 in which the joining members are hog rings.

3. The mattress spring construction of claim 1 in which the frame member is a shaped single piece rod element of rectangular plan profile, the transverse frame segments being of greater length than the longitudinal frame segments.

4. The mattress spring structure of claim 1 in which the means for securing the longitudinal and transverse frame segments to the coil springs in the respective transverse and longitudinal coil spring rows comprises clip fasteners.

5. The mattress spring structure of claim 1 in which the frame member is a shaped rod element.

6. The mattress spring structure of claim 1 in which the frame is of six gauge carbon steel material.

7. The mattress spring structure of claim 1 in which the frame is of nine gauge high carbon steel material.

8. The mattress spring structure of claim 1 in which the number of transverse rows of coil springs in an upper spring structure area between the upper margin and the central area and in a lower structure area between the lower margin and the central area are substantially equal and greater in number than those in the central area.

9.The mattress spring structure in accordance with claim 9 in which the number of transverse rows of coils in the upper, central and lower areas is in a proportion 3:2:3.

* * * * *